United States Patent [19]

Stupp et al.

[11] Patent Number: 4,560,908

[45] Date of Patent: Dec. 24, 1985

[54] HIGH-FREQUENCY OSCILLATOR-INVERTER BALLAST CIRCUIT FOR DISCHARGE LAMPS

[75] Inventors: Edward H. Stupp, Spring Valley; Mark W. Fellows, Monroe; Walter G. Steneck, Ossining, all of N.Y.

[73] Assignee: North American Philips Corporation, New York, N.Y.

[21] Appl. No.: 382,734

[22] Filed: May 27, 1982

[51] Int. Cl.[4] ..... H05B 37/00

[52] U.S. Cl. ..... 315/219; 315/223; 315/283; 315/307; 315/DIG. 7

[58] Field of Search ..... 315/219, 223, 283, 307, 315/DIG. 7

[56] References Cited

U.S. PATENT DOCUMENTS

| | | | |
|---|---|---|---|
| 3,579,026 | 5/1971 | Paget | 315/258 |
| 3,703,677 | 11/1972 | Farrow | 315/254 |
| 3,710,177 | 1/1973 | Ward | 315/244 |
| 3,769,545 | 10/1973 | Crane | 315/219 |
| 4,017,785 | 4/1977 | Perper | 315/221 |
| 4,259,614 | 3/1981 | Kohler | 315/244 |
| 4,346,332 | 8/1982 | Walden | 315/307 |
| 4,395,659 | 7/1983 | Aioke et al. | 315/307 |

*Primary Examiner*—Harold Dixon

*Attorney, Agent, or Firm*—Robert T. Mayer; Bernard Franzblau

[57] ABSTRACT

A current fed high frequency oscillator-inverter ballast circuit includes a parallel resonant tank circuit for driving a pair of series connected discharge lamps via a series ballast capacitor. A regenerative power supply switches on when a fluctuating main DC supply voltage drops below a given level thereby providing a constant level auxiliary DC supply voltage to the oscillator inverter to maintain oscillation and lamp operation. When the main DC supply voltage exceeds said given level, the regenerative power supply switches out. The oscillation frequency is $f_2$ during operation of the main supply and automatically switches to a frequency $f_1$ when the regenerative power supply takes over. The frequency shift is automatic during each half cycle of a 60 Hz AC supply and is in a direction so as to maintain lamp current relatively constant. A novel high frequency leakage transformer may be provided to couple the high frequency inverter to the discharge lamp load to provide both a current limiting (ballast) action and automatic control of the lamp heater current to maintain high efficiency operation.

16 Claims, 5 Drawing Figures

10
12
13
14
15
16
17
18
19
20
21
22
23
25
26
27
28
29
30
31
32
33
34
35
36
37
38
39
40
41
42
43
44
45
46
47
48
49
50
51
52
Vcc
120V
60Hz

T
V
F1
F2
F2
F1

T
V
V Max
V Min

HIGH-FREQUENCY OSCILLATOR-INVERTER BALLAST CIRCUIT FOR DISCHARGE LAMPS

BACKGROUND OF THE INVENTION

This invention relates to a high frequency circuit for starting and ballasting gas discharge lamps. More particularly, the invention relates to a high efficiency, high frequency electronic inverter circuit for operating one or more electric discharge lamps.

One significant feature or aspect of the present invention is the provision of a unique oscillator-inverter ballast circuit that produces multiple high frequency modes of operating frequency in which the inverter frequency of operation automatically changes during each period of the 60 Hz AC supply voltage in a manner so as to regulate the lamp discharge current.

The prior art has employed a variety of techniques for energizing and ballasting electric discharge lamps. The early ballast circuits were energized by means of a DC voltage or a 60 Hz AC voltage and, in the case of the AC supply voltage, necessitated the use of a rather large magnetic ballast transformer. These early ballast circuits were characterized by a relatively poor efficiency caused in part by the relatively large power losses in the ballast system itself. More recently it has been proposed to improve the efficacy of a system for energizing discharge lamps by operating the lamps at a high frequency, generally in a range of 15 KHz to 50 KHz.

One such high frequency ballist system is described in U.S. Pat. No. 4,220,896 by D. A. Paice. This patent discloses a high frequency resonant feedback inverter energized from a DC power source for operating a discharge lamp via a ballast circuit including an inductor and capacitor connected in series. The discharge lamp is connected across the capacitor and the inverter frequency is adjusted to regulate the inverter AC output voltage level and to maintain almost unity power factor at the input to the ballast filter.

U.S. Pat. No. 4,259,614 by T. P. Kohler employs a push-pull transistor oscillating inverter for energizing a pair of discharge lamps via a ballast circuit comprising a series resonant LC circuit that determines the inverter oscillation frequency. The peak lamp current is sensed and used to control the inverter frequency so that the frequency is reduced as the lamp current is increased, thereby limiting the power dissipation of the circuit.

Another high frequency inverter oscillator is illustrated in U.S. Pat. No. 4,017,785 by L. J. Perper which provides a supplemental DC power supply connected so as to supplement a fluctuating main DC supply to maintain continuous oscillator operation and to substantially reduce the peak AC line current.

A second unique aspect of the present invention is the provision of a novel magnetic impedance transformer for coupling the inverter oscillator to the discharge lamp or lamps. A high frequency leakage reactance transformer is used to provide an automatic reduction in the heater power or current supplied to the discharge lamp filament electrodes once the lamp ignites thereby producing a so-called auto-heat mode of operation. At the same time, the leakage reactance of the transformer also produces a ballast function to protect the discharge lamp.

The use of a small high frequency leakage inductance transformer for coupling a high frequency inverter-oscillator to a discharge lamp is shown in U.S. Pat. No. 3,579,026 in the name of F. W. Paget. This patent discloses a full wave rectifier which supplies an unfiltered rectified direct current to a high-frequency oscillator inverter that is coupled to a pair of discharge lamps via the high frequency leakage transformer. The inverter oscillation frequency is dependent on the applied voltage. The lamps have preheatable electrodes energized by secondary windings of the leakage transformer which are tightly coupled to the transformer primary winding. A low frequency ballast utilizing a manually adjusted variable reactance to control the lamp discharge current is described in U.S. Pat. No. 2,458,277 by G. T. K. Lark et al. In the Lark et al ballast the heating current for the lamp filaments is reduced as the lamp discharge current is increased. And Canadian Pat. No. 670,797 discloses a discharge lamp ballast circuit including a novel arrangement of transformer windings by means of which the heating voltage for the lamp electrodes is higher before lamp ignition than it is after ignition.

SUMMARY OF THE INVENTION

Accordingly, it is a prime object of the present invention to provide an improved static inverter for operation of one or more gas discharge lamps.

Another object of the invention is to provide a novel lightweight and physically small ballast-inverter which is simple and economical in construction and reliable in operation.

A further object of the invention is to provide a ballast-inverter which exhibits a high efficiency and a system power factor approaching unity.

Still another object of the invention is to provide a ballast-inverter in which the third harmonic distortion is reduced to a very low level and radio frequency interference (RFI) is substantially eliminated.

Another object of the invention is to provide a ballast-inverter which supplies an essentially sinusoidal output voltage to the discharge lamps with the concomitant benefits derived therefrom.

In accordance with the second aspect of the invention, another principle object of the invention is to provide the high frequency ballast-inverter with a novel leakage reactance transformer which provides not only inductive ballasting of the discharge lamps, but also automatic control of the lamp filament currents to provide optimum cathode temperature before and after lamp ignition thereby providing extended lamp life and higher system efficacy due to a reduction in system power losses.

A further object of the invention is to provide an improved high frequency ballast transformer that will simultaneously provide automatic control of the lamp heater power and high efficiency ballasting of the lamp operating current.

Another object of the invention is to provide an improved high frequency ballast transformer with substantially reduced levels of conducted and radiated interference.

These and other objects are achieved in accordance with the present invention by providing a high frequency ballast-inverter for one or more gas discharge lamps comprising a current-fed class D high frequency oscillator-inverter supplied with an unfiltered rectified direct current from an AC-DC converter. A demodulator circuit in the form of a switched regenerative power supply is coupled to the class D oscillator and supplies power to the inverter-oscillator whenever the varying unfiltered DC input voltage drops below a given level. The inverter-oscillator is coupled to the lamp load by means of a high frequency impedence matching transformer and an additional series connected capacitor or inductor for current limiting ballast purposes. The provision of a new and improved leakage transformer as the matching transformer makes it possible to eliminate the series connected reactive ballast element. The oscillation frequency of the inverter is dependent on the level of the inverter supply voltage and automatically varies so as to vary the impedance of the series connected reactive ballast element in a sense to maintain the lamp current approximately constant even in the presence of a 120 Hz ripple component of the supply voltage.

The provision of the regenerative power supply makes it possible to substantially reduce the size of the large filter capacitor normally utilized in the AC/DC converter thereby providing a high power factor and a low inrush current. A tuned network is included in the regenerative power supply in order to reduce the third harmonic level in the power supply lines and to reduce the interference fed back into said power lines. The demodulator circuit also reduces the line frequency ripple to a level so as to insure that the minimum peak lamp voltage is always greater than the lamp arc voltage so that the lamp does not deionize. An additional benefit is that the inverter/oscillator frequency is modulated so as to reduce lamp current variations due to any 120 Hz residual ripple from the rectified line voltage.

The high frequency transformer for coupling the oscillator to the lamps may consist of the transformer discribed in U.S. Pat. No. 4,453,109 or a new leakage reactance transformer arrangement (discribed below) which provides not only the current limiting ballast function but also automatic control of the heater power for the discharge lamps. The new transformer produces a heater power (current) that has an inverse relationship to the lamp current. In particular, the heater power is automatically reduced after ignition of the discharge lamp in order to provide the optimum cathode temperature for extended lamp life due to minimum deterioration of the cathode.

The high frequency leakage transformer consists of a ferromagnetic core (e.g. a ferrite material) including a primary section, a secondary section and a shunt section that contains a gapped core, i.e. an air gap or the like. The primary winding is designed to have an inductance value that will form a parallel resonant circuit with a parallel capacitor to determine the fundamental operating frequency of the oscillator-inverter. The primary winding will consist of N turns of wire which, in conjunction with an adequate cross-section of the ferrite core, will insure that the transformer primary core section does not saturate. Preferably, the transformer is dimensioned so that no portion of the entire transformer core will be allowed to saturate, thereby producing low power dissipation in the transformer, optimum power coupling and low distortion.

The transformer secondary winding, consisting of M turns of wire, is mounted on the transformer secondary section and is physically separated from the primary winding and functions as a leakage reactance (inductance) which is coupled to the primary only via the magnetic field.

The transformer secondary section also includes the filament heating windings for the discharge lamp (or lamps) which normally will have a low turns ratio relative to the secondary winding turns, M. The heater windings are preferably tightly coupled to the secondary winding, although this is not an essential requirement of the leakage transformer. A portion of the heater winding may also be wound around the magnetic shunt portion of the transformer magnetic circuit in order to develop a nonlinear response function, which may be desirable in special applications.

Before ignition of the discharge lamp, essentially all of the magnetic flux generated by the primary winding links the secondary to provide the maximum heater power for the lamp filament as well as the requisite high open circuit voltage for ignition of the lamp. After ignition, some of the magnetic flux is coupled through the gapped leg of the transformer core so that the secondary flux linkage decreases, resulting in a reduced cathode heater power. The change in flux coupling to the secondary section is influenced by the secondary winding turns (M) and the current flowing in the secondary winding. A decrease in lamp current results in an increase of heater current and vice versa so that the heater power bears an inverse relationship to the lamp current. This mode of operation is termed the auto-heat mode and results in higher efficiency due to the reduction in heater power during lamp operation. The reduced coupling to the secondary after lamp ignition provides a leakage reactance for limiting the lamp current. The ballast function for the lamp is now provided by the transformer leakage reactance making it possible to eliminate or reduce in size the usual ballast capacitor or inductor.

The secondary impedance is frequency sensitive and is coupled to the discharge lamp load and sets the operating levels of this load. As the oscillator-inverter operating frequency, which is determined by the primary resonant tank circuit and the magnetically reflected reactance from the secondary, varies, the secondary impedance will also vary. The variation in secondary impedance modifies the resonant frequency of the oscillator-inverter such that the power delivered by the secondary to the lamp load tends to remain constant during lamp operation.

It is a further object of the invention to provide an improved non-saturating leakage transformer exhibiting low power dissipation and optimum power coupling.

BRIEF DESCRIPTION OF THE DRAWINGS

The novel and distinctive features of the invention are set forth in the appended claims. The present invention, both as to its organization and manner of operation, together with further objects and advantages thereof, may best be understood by reference to the following description taken in connection with the accompanying drawings in which:

DESCRIPTION OF THE PREFERRED EMBODIMENTS

Figure 1:
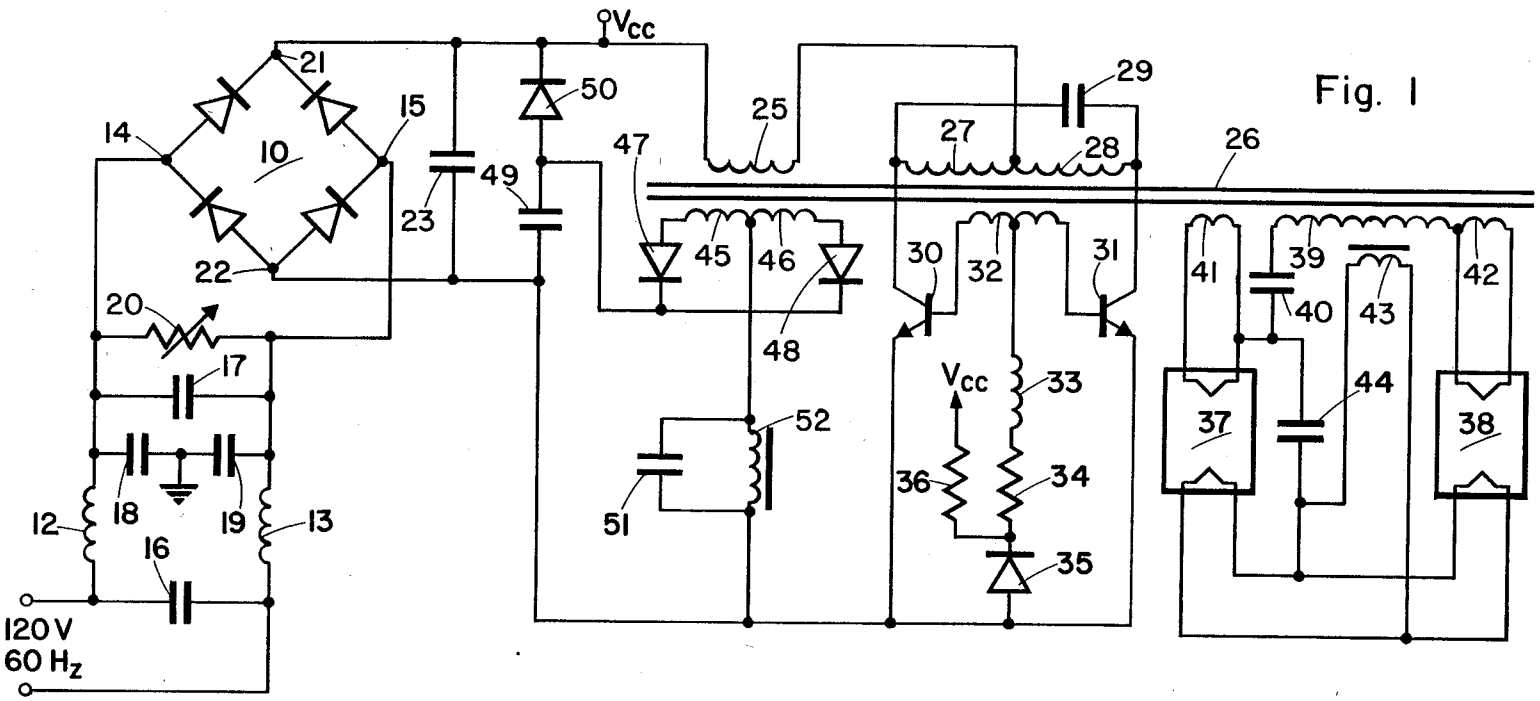
FIG. 1 is an electric schematic diagram of a preferred embodiment of the oscillator-inverter for the ignition and operation of one or more gas discharge lamps.

Referring now to FIG. 1 of the drawings, a low frequency AC supply voltage, e.g. 120 volt 60 Hz, is coupled across a bridge rectifier 10 via an RFI filter 11. The passive RFI filter 11 will minimize the interaction between the power lines and the oscillator-inverter and consists of a pair of bifilar coils 12 and 13 wound on the same core (e.g. two E cores, a toroid core, etc.) and each is connected between a respective AC supply terminal and a bridge input terminal 14 and 15. The coils are connected and wound so that the mutual coupling will attenuate the high frequencies while passing the 60 Hz line current. The filter also includes a capacitor 16 connected across the 60 Hz AC input terminals and a capacitor 17 connected across the bridge input terminals 14 and 15. The capacitors provide normal (differential) mode rejection of high frequency conducted radiation.

Capacitors 18 and 19 are connected in series across terminals 14 and 15 with a junction point therebetween connected to ground. These capacitors are chosen so as to provide a maximum amount of common mode filtering while limiting leakage currents to a value less than 5 ma peak. The RFI filter is a basic $\pi$ section low pass filter that provides 60 db/decade attenuation above the cutoff frequency ($2\pi\sqrt{LC}$).

A varistor element 20 is coupled across the terminals 14 and 15 to provide transient voltage suppression and protection of the ballast circuit from the AC power lines by virtue of its voltage dependent nonlinear resistance function ($I=KV^{\alpha}$ where $\alpha$ represents the nonlinearity of conduction which will normally be greater than 25 for a varistor device to be used in a ballast circuit. Upon the occurrence of a high voltage transient across VDR 20, its impedance changes from a very high value (approximately open circuit) to a relatively low value so as to effectively clamp the transient voltage to a safe level. The inherent capacitance of varistor 20 will provide an added filter function.

The bridge rectifier 10 rectifies the 60 Hz line voltage applied to its input terminals 14, 15 to derive at the ouptut terminals 21, 22 a pulsating DC output voltage with a 120 Hz modulation envelope. Smoothing of this pulsating DC voltage is provided by a unique tuned regenerative power supply, to be described below. With this supply, the maximum voltage ($V_{max}$) will correspond to the peak voltage of the 60 Hz AC input voltage, whereas the minimum voltage ($V_{min}$) will correspond to a minimum value selected to minimize the period during which the voltage does not change, while insuring that the discharge lamps do not extinguish at any time within each 60 Hz period of operation. The smoothed pulsating DC supply voltage at the bridge output terminals 21, 22 will then have a general wave shape as illustrated in FIG. 2A.

A low value smoothing capacitor 23 (e.g. approximately 0.5 $\mu$F) is coupled across the bridge output terminals to provide RFI suppression, additional transient suppression, and a minimal filtering action. Because of its low value, the circuit exhibits a high power factor.

A high frequency oscillator-inverter stage 24 is supplied with the pulsating DC voltage via an inductor coil 25 which is wound on a high frequency coupling transformer 26 and is gapped to handle a DC current. The inductor 25 is connected to a center tap of the transformer primary winding 27, 28. A capacitor 29 is connected in parallel with the primary winding 27, 28 and has a capacitance value chosen to resonate with the primary inductance at the selected frequency of the oscillator-inverter circuit ($f_o=\frac{1}{2}\pi\sqrt{LC}$).

A pair of NPN switching transistors 30, 31 have their collector electrodes respectively connected to opposite ends of the primary winding 27, 28 and their emitter electrodes connected to output terminal 22 of the bridge rectifier. This circuit may be termed a current fed (via series inductor 25) parallel resonant (27–29) switched mode power oscillator/amplifier. The circuit is extremely efficient in generating a high frequency output and, if all components were ideal (no losses), it would have an efficiency of 100%. A practical circuit will have an efficiency exceeding 95%.

A transformer secondary winding 32 has end terminals connected to the base electrodes of switching transistors 30 and 31 and a center tap connected to bridge output terminal 22 via a series circuit consisting of inductor 33, resistor 34 and diode 35. The winding 32 and the series circuit 33–35 demonstrate one means for providing the switching drive signals for transistors 30 and 31. Other appropriate base drive circuits for bipolar transistors may also be used.

Although transistors 30 and 31 are bipolar transistors in the preferred embodiment, other semiconductor switches may be used, such as JFETs, MOSFETs, TRIACs etc. A starting resistor 36 couples a source of voltage $V_{cc}$ (terminal 21) to the junction point between resistor 34 and diode 35 so as to apply the voltage $V_{cc}$ to the base electrodes of the switching transistors in order to start the circuit oscillating. The base drive circuit provides essentially a square wave of current to the transistors so that the transistor switches are driven into a saturation state in the on condition.

The inverter circuit for converting the DC supply voltage into a high frequency AC voltage is thus seen to consist of a pair of active switches, transistors 30, 31, and a tuned parallel resonant circuit 27–29. The transistor switches are driven by the base drive circuit 32–35 so that they act like a two pole switch which defines a rectangular current waveform. As the resonant circuit is tuned to the switching frequency, harmonics are removed by it so that the resultant output voltage is essentially sinusoidal. The choke coil 25 forces essentially a constant DC current ($I_{dc}$) into the center tap of primary winding 27, 28. Each switching transistor carries the full DC current when it is on so that the current through each transistor varies from zero to $I_{DC}$. The switching transistors conduct in mutually exclusive time intervals.

A pair of series connected discharge lamps 37 and 38 are coupled to transformer secondary winding 39 via a series ballast capacitor 40. The discharge lamps may consist, for example, of conventional rapid start 40 W fluorescent lamps. The lamp cathodes are heated by means of transformer secondary windings 41, 42 and 43. In this case, the output voltage of each of these windings will be chosen to conform to the requirements for igniting rapid start lamps. A capacitor 44 is connected in parallel with discharge lamp 37 in order to provide sequential starting of the lamps after proper cathode heating thereof.

In order to insure that one lamp starts before the other and that neither lamp will "instant start", the open circuit voltage across the windings 41, 42 is adjusted, by means of the transformer winding turns ratio, to be lower than the value required to instant start a discharge lamp. In some cases the capacitor 44 will not be required, especially where the inherent lamp to lamp and lamp to ground plane capacitance is sufficient to produce lamp ignition.

The capacitor 40 operates as a frequency dependent variable impedance connected in series with the discharge lamps so as to ballast the lamps by limiting and controlling the lamp current. As will be explained in greater detail below, a change in the operating frequency of the oscillator-inverter circuit will result in a change in the impedance of series capacitor 40 in a direction that tends to maintain the lamp current constant. Although a capacitor is used as the ballast element in the circuit shown, it could be replaced by another frequency dependent impedance element, such as an inductor.

The demodulator or switched regenerative power supply in combination with the low capacitance value of capacitor 23 provides a high power factor for the system, harmonic suppression, i.e. a reduction in the harmonic content of the AC line current, and automatic frequency variation of the oscillator-inverter. The regenerative power supply consists of another pair of transformer windings 45, 46 coupled to a full wave rectifier circuit including diodes 47, 48. The windings 45, 46 are bifilar wound and tightly coupled to the primary windings 27, 28 of the transformer. The cathodes of diodes 47, 48 are connected together to a common junction point between a series circuit consisting of capacitor 49 and diode switch 50. This series circuit is connected across the output terminals 21, 22 of the bridge rectifier 10. A center tap on the windings 45, 46 is connected to terminal 22 via a resonant "smoothing" filter consisting of a capacitor 51 and an inductor 52 connected in parallel.

The LC network 51, 52 forms a parallel resonant tank circuit which effectively integrates the peak charging currents that would otherwise flow into capacitor 49 during the conductance of diodes 47 and 48. In so doing, it provides a smooth and continuous energy transfer out of the tank circuit 51, 52 and into the storage capacitor 49. By adjusting the LC network 51, 52 it is possible to control and vary the harmonic content of the input 60 Hz AC supply current. A proper choice of the inductance and capacitance values will result in acceptable levels of the third, fifth, etc. harmonics without adversely affecting the operation of the rest of the circuit.

A similar circuit constructed with an equivalent regenerative power supply but without this tuned LC network will have an unacceptable level of line current harmonic contents, e.g. above 40% for the third harmonic. Although the "smoothing" network is shown as a single parallel LC network, other circuits may be designed to perform the same function. The regenerative power supply may be implemented using active circuits to control and regulate a regenerative power source. For example, the diode switch 50 may be replaced by an active switch, e.g. a MOSFET, JFET, etc which is triggered in accordance with the requirements of the inverter circuit, the load and the input 60 Hz AC line.

The elements 45–52 together comprise a regenerative power supply which effectively demodulates the rectified 60 Hz AC supply voltage and powers the oscillator-inverter during the period when diode 50 conducts. The turns ratio of bifilar windings 45, 46 are chosen so as to provide a feedback voltage at the output of diode 50 (terminal $V_{cc}$) sufficient to keep the lamp voltage above the deionization potential while at the same time minimizing the time period during which the demodulation function occurs. The diodes 47, 48 are preferably fast recovery rectifier devices characterized by a low reverse recovery time ($t_{rr}$) along with a soft reverse recovery characteristic to minimize RFI problems.

A high frequency AC signal is developed in the windings 45, 46 of the transformer and is rectified by the diodes 47, 48 and stored as a DC voltage level on capacitor 49. This capacitor should be chosen so that it can store sufficient charge to provide enough power to operate the oscillator-inverter while the demodulation function is occurring.

Diode 50 functions as a switch which turns on whenever the rectified pulsating 120 Hz DC voltage at terminal 21 is at a level below the voltage across capacitor 49. During this time the diode bridge 10 is back biased thereby effectively isolating the AC power lines from the frequency conversion stage. Thus, the energy to drive the oscillator-inverter is supplied by capacitor 49 via diode switch 50. When the recitified pulsating DC supply voltage again rises above the voltage on capacitor 49 (also capacitor 23), the diode 50 is back biased so that the regenerative power supply is effectively switched off.

During the time that diode 50 conducts, the voltage across capacitor 23 follows the voltage across capacitor 49. Therefore, with diode 50 on, the voltage $V_{cc}$ at terminal 21 is nominally the voltage on capacitor 49 so that the peak voltage at the collectors of transistors 30 or 31 is $\pi$ times the voltage of capacitor 49. During this time, the cathodes of diodes 47 and 48 are at the voltage level of the capacitor, whereas their anodes receive a voltage $\pi$ times this capacitor voltage reduced by the turns ratio of the windings 45, 46 to the windings 27, 28. This ratio may be selected so that the diodes are nonconductive and thus the network including capacitor 51, inductor 52 and capacitor 49 will be isolated from the tank circuit. The "off" time of the diodes is chosen as a balance between the amount of demodulation and the power losses in the regenerative feedback circuit.

With the diode 50 biased off and with the voltage $V_{cc}$ at terminal 21 increasing toward the peak voltage of the 60 Hz AC supply voltage, a point will be reached where diodes 47 and 48 begin to conduct, thus effectively shunting the parallel resonant circuit 27–29 with the regenerative power supply. The reflected impedance, tightly coupled to the primary of transformer 26, will effectively modify the resonance frequency of the parallel resonant circuit 27–29 to produce a shift in frequency of the oscillator-inverter.

The solid state power supply of this invention features a high frequency oscillator-inverter that produces multiple-modes of operating frequency, i.e. the frequency of operation varies over a given 60 Hz period. In particular, the circuit described above will operate at all times at the frequency required to provide a continuous lamp current over a full 60 Hz cycle. This is achieved by operating the oscillator-inverter at two distinct high frequency limits, $f_1$ and $f_2$, with a smooth transition between the two frequencies. The oscillation output frequency of the oscillator-inverter is automatically modified without changing the resonant components or the lamp circuitry, and with essentially a sine wave output voltage for driving the discharge lamps at all times.

The regenerative power supply circuit makes it possible to use a simple bridge rectifier system (10) without the need for a large value filter capacitor, as is required in most conventional AC-DC bridge circuits. The use of a regenerative power supply provides a system power factor above 90% and at the same time reduces the harmonic content of the line current and the level of conducted radiation. This same circuit is also the control element which makes possible the frequency shift of the series fed parallel resonant tank circuit 27–29.

The power supply output stage consists of an impedance matching transformer and a series reactance to limit lamp current. The transformer also provides continuous filament power for operation of the lamps. The reactive element (either capacitive or inductive) in series with the lamp has its impedance varied by varying the oscillator-inverter operating frequency in a sense so as to maintain the lamp current within selected limits, thus insuring that the plasma never deionizes.

Figure 2B:
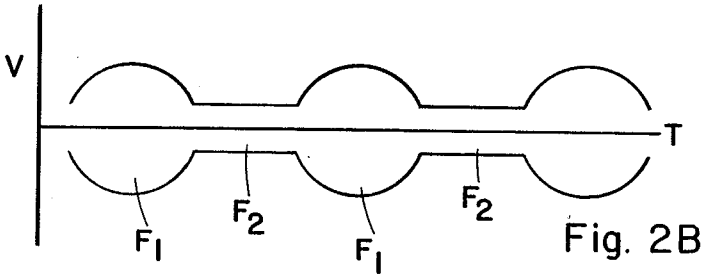
FIGS. 2A and 2B illustrate waveforms useful in describing the operation of the apparatus of FIG. 1.
Figure 2A:
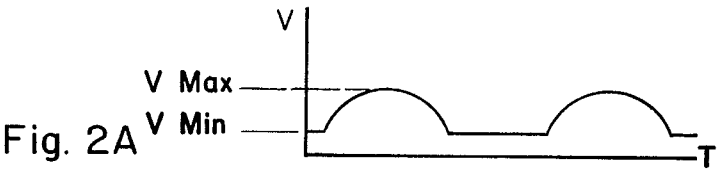

The modulation envelope of the high frequency signal generated by the oscillator-inverter circuit without a load is shown in FIG. 2B. The frequencies $f_1$ and $f_2$ will be found within the modulation envelope. The sinusodial high frequency $f_1$ will occur in the region of maximum supply voltage and the sinusoidal high frequency $f_2$ will occur during the period when the regenerative power supply is coupled to the oscillator-inverter via diode switch 50. The voltage supplied to the oscillator-inverter during the latter period is substantially constant, as is evident from the horizontal flat portions of the waveforms in FIGS. 2A and 2B. During the period when the regenerative power supply is decoupled from the oscillator-inverter, the frequency $f_1$ is generated with the amplitude of the sine waves varying with the amplitude variations of the rectified pulsating DC voltage supplied by bridge recitifier 10 at its output teminals 21, 22.

The frequencies $f_1$ and $f_2$ within the modulation envelope will vary dependent on whether the series reactance element for the discharge lamps is inductive or capacitive, and also on the choice of circuit elements. For the case where the series reactance is capacitive, i.e. capacitor 40 in FIG. 1, the circuit will be adjusted so that the frequency $f_1$ is less than the frequency $f_2$, e.g. a 25–30% differential in tank frequency. Thus, when the oscillator supply voltage is at its low value, represented by the flat portion of the supply voltage waveform (FIG. 2A), a voltage of frequency $f_2$ is generated to produce a lamp current of a given amplitude. When the supply voltage increases, i.e. after the regenerative power supply is cut-out by diode switch 50, then the oscillator-inverter generates a higher amplitude voltage. This higher voltage would tend to increase the lamp current. However, when the regenerative power supply was effectively switched out of the circuit, there occurred a change in the reflected impedance of the secondary circuit of transformer 26 that produces a change in the frequency of oscillation of the oscillator-inverter circuit to the lower frequency $f_1$. This lower frequency voltage $f_1$ is coupled via the transformer 26 and series capacitor 40 to the lamps. The lower frequency $f_1$ causes an increase of the capacitive reactance so as to maintain the lamp current fairly constant despite the substantial variation in supply voltage over a full period of the 60 Hz AC supply.

It is therefore seen that the change in reflected impedance into the parallel resonant tank circuit as the regenerative power supply is switched in and out of the circuit at a predetermined level of the pulsating DC voltage produces an automatic change in the oscillation frequency in a direction so as to maintain the lamp current constant by an automatic variation of the impedance of the series reactance element.

For the case where the series capacitor 40 is replaced by an inductor, the frequency $f_1$ generated will be greater than the frequency $f_2$. Thus, for an inductive ballast the higher operating frequency will occur at the peak values of the supply voltage while the lower frequency will be produced during the period of lower supply voltage, which occurs when the circuit is operated by the fixed DC voltage of the regenerative power supply circuit. The inductive reactance thus will be higher for the higher values of the supply voltage so as to maintain a constant lamp current. It should be noted that the frequency transition between the frequencies $f_1$ and $f_2$ and vice versa is essentially smooth and occurs during the period that the regenerative power supply is coupled to the oscillator-inverter via the conductive diode switch 50. By maintaining a given minimum DC supply voltage when the bridge supply voltage is low, the regenerative power supply thus prevents the deionization of the lamps during normal operation.

The frequencies $f_1$ and $f_2$ are chosen so that the lamp current will be held within prescribed limits to obtain an optimum lamp current crest factor, related to extended lamp life, and optimum generation of 254 nm radiation within the arc for a maximum conversion of energy by the phosphor into useful light.

Figure 3:
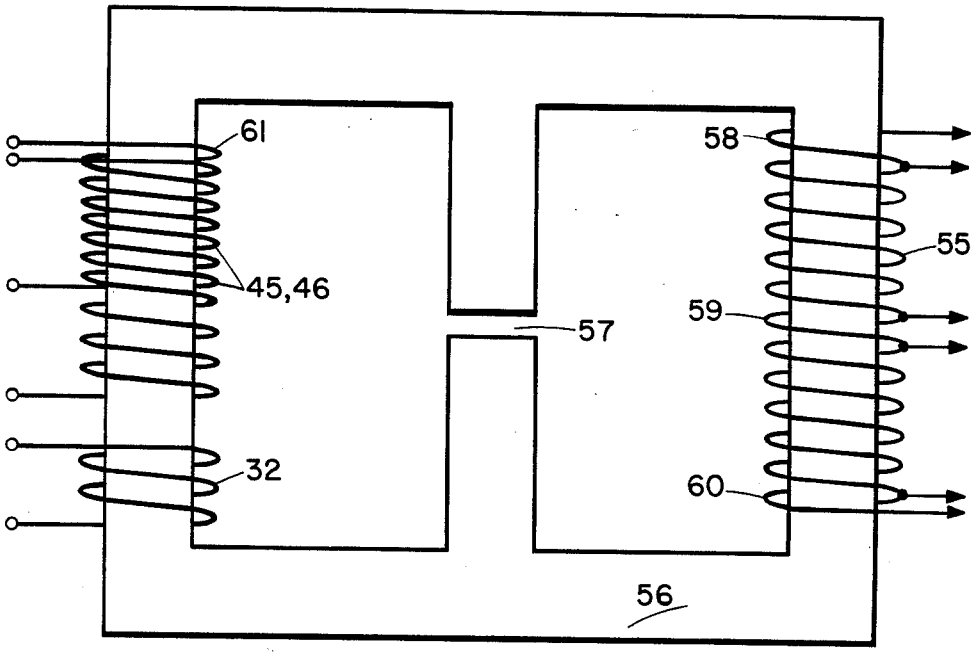
FIG. 3 shows an improved leakage reactance transformer adapted for use in the apparatus of FIG. 1 for coupling the oscillator-inverter stage to the discharge lamps.
Figure 4:
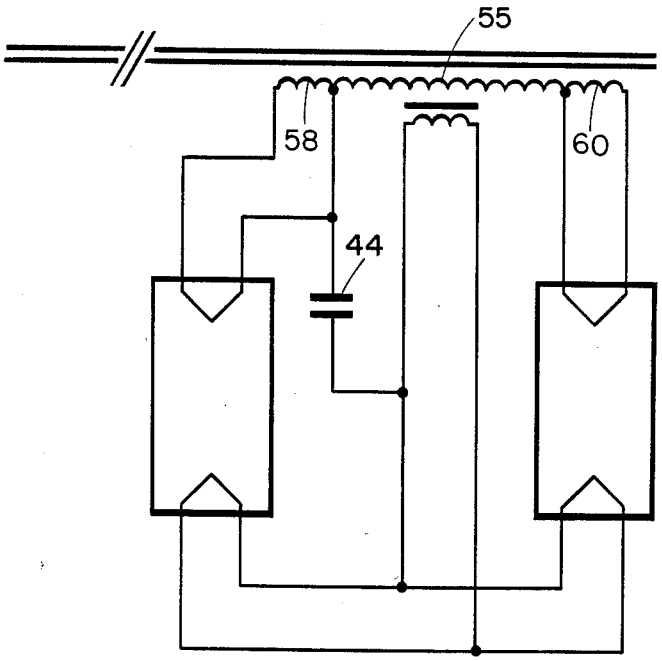
FIG. 4 is an electric schematic diagram showing a portion of the electrical connections of the transformer of FIG. 3 for use as a coupling transformer for a pair of discharge lamps.

FIG. 3 illustrates an impedance transformation device in the form of a new leakage transformer configuration that provides both a current limiting (ballast) function and an automatic control of the lamp heater power so as to improve the efficiency of the overall power supply-ballast system. The leakage transformer will couple the oscillator-inverter circuit to the discharge lamps and may therefore be substituted for the transformer 26 and ballast capacitor 40 of FIG. 1, thus saving on a ballast capacitor. Inductive ballasting of the discharge lamps is now achieved by means of the leakage reactance of the transformer itself. The lamps thus may be connected directly across the transformer secondary winding 55 so that the varying reactance of the secondary will limit and control the lamp volt-ampere requirements. This leakage transformer arrangement provides a significant reduction in radiated and conducted RFI. The connections between the transformer secondary windings and the discharge lamps are illustrated in FIG. 4. The windings 32, 45, 46 of the transformer are connected in an identical manner to that shown for the transformer in FIG. 1 and will therefore not be further illustrated.

The high frequency leakage transformer includes a magnetic core 56, preferably of ferrite material, with an air gap 57 formed in the middle leg. The secondary winding 55 along with the lamp heater windings 58, 59 and 60 are wound on the right leg of the transformer core and a primary winding 61 is wound on the left leg. The heater windings are thus tightly coupled to the secondary winding 55. The capacitor 29 of FIG. 1 will be connected in parallel with the primary winding 61 to form therewith a tuned parallel resonant tank circuit for the oscillator-inverter stage. The ends of the primary winding are connected to the collector electrodes of switching transistors 30, 31 (FIG. 1).

The secondary portion of the transformer is not electrically connected to the primary winding and will provide both the transfer of energy to the load and the control and regulation of the load, especially where the load is a negative impedance device such as a discharge lamp.

In order to ignite the discharge lamps coupled to secondary winding 55, the open circuit voltage across the secondary must exceed the voltage required to initiate a discharge in the lamp. For the case of a fluorescent lamp load, the transformer also provides the power to produce electron emission of the lamp cathodes, which assists in the initiation of the discharge. The heater windings 58–60 for the discharge lamps are tightly coupled to the secondary of the transformer such that, when there is no load current flowing, and thus no current in the secondary, the heater windings provide a maximum power transfer to the lamp cathodes.

The transformer consists of primary and secondary sections plus a shunt section comprising a gapped core and with the primary winding inductance resonated with a parallel capacitor to set the fundamental operating frequency of the oscillator-inverter. The primary winding is composed of N turns of wire and the ferrite core has an adequate cross-section to insure that the transformer primary section does not saturate. In fact, it is preferable to arrange the transformer so that no portion of the entire transformer will be allowed to saturate at any time, thus providing low power dissipation in the transformer, minimum distortion and optimum power coupling.

The transformer secondary is physically separated from the primary. It is a leakage reactance (inductance) which is coupled to the primary only by means of the magnetic field. With no secondary load, the secondary open circuit voltage will be determined by the primary to secondary turns ratio. Before ignition of the lamps, essentially all of the magnetic flux generated by the primary winding links the secondary winding to provide maximum heater power and open circuit voltage. After lamp ignition, a current flows in the secondary winding so that some of the primary flux flows through the gapped center leg of the core 56, thus providing a leakage reactance for limiting the lamp current. The flux linkage or coupling to the secondary is reduced after lamp ignition which also results in an automatic reduction of the cathode heater power.

The impedance of the secondary winding, which is in parallel with the load (lamps) and sets the load operating level, is frequency sensitive. As the oscillator-inverter operating frequency, determined by the resonated primary and magnetically reflected reactance from the secondary, varies, the secondary impedance will vary so as to modify the resonant frequency (oscillation frequency) of the apparatus in a manner such that the power delivered by the secondary to the lamps tends to remain constant. The magnetic circuit will vary as required to control the load power, and the volt-ampere characteristics of the load will be governed by the variations in the impedance of the secondary winding.

The operation of the transformer after lamp ignition may also be explained in the following manner. As current flows in the secondary, conservation of primary magnetic flux coupled with the magnetic flux generated by the secondary results in flux leakage across the relatively high magnetic reluctance of the gapped shunt portion. This effectively results in a variation in magnetic coupling to the secondary. As the magnetic coupling varies, the resultant reactance of the secondary winding will also vary as it is a function of both the number of turns and the generated magnetic flux carried by the ferrite core on which the winding is mounted. This effect is equivalent to a secondary leakage reactance.

Another way of looking at the transformer operation is that a constant primary flux flows before ignition and the ferrite core provides a low reluctance path. After lamp ignition, the current flow in the secondary winding causes a reverse flux to flow so that less of the primary flux is coupled to the secondary winding and the heater windings.

This mode of operation has been termed the auto-heat mode in which the heater power bears an inverse relationship to the lamp current. In contrast, the apparatus of FIG. 1 provides a relatively constant cathode heater power. After ignition in the apparatus of FIGS. 3 and 4, the flux linkage decreases resulting in reduced heater power. A subsequent decrease in lamp current results in an automatic increase of heater current. For example, if the lamps are dimmed, resulting in a reduced lamp current, the filament heat (current) will automatically be increased to maintain the filament temperature. After ignition, the heater current is significantly reduced which provides optimum cathode temperature and extended lamp life due to a slower deterioration of the lamp cathodes. If a power interruption occurs and the lamps current stops, or is appreciably reduced, the filament heat will automatically return to the required level to provide the optimum filament temperature.

The cathode heater windings of the leakage transformer will normally have a low turns ratio in relationship to the turns of the secondary winding 55. It is alternatively possible to wind a portion of the heater windings around the magnetic shunt portion of the transformer core in order to develop a non-linear response function. The amount of the reduced heated current after ignition is related to the turns ratio of the heater windings to that of the secondary winding and to the current flowing in the secondary. Minimum power losses are insured by designing the magnetic structure of the transformer so that it never saturates. The operation of the oscillator-inverter ballast using the leakage transformer of FIG. 3 for coupling the lamps to the oscillator-inverter stage will be the same as that described in connection with FIG. 1 for a circuit which is inductively ballasted.

While we have described our invention in connection with certain specific embodiments and applications, other modifications and alterations thereof will be readily apparent to those skilled in the art without departing from the spirit and scope of the invention as defined in the appended claims.

What is claimed is:

1. A high frequency oscillator-inverter for starting and operating at least one electric discharge lamp from a low frequency AC power source comprising, a pair of input terminals for connection to the AC power source, a rectifier circuit having an input coupled to the input terminals and an output for supplying a fluctuating DC voltage, an oscillator-inverter circuit including at least one transistor, a ballast coupling circuit for coupling the output voltage of the oscillator-inverter circuit to at least one said discharge lamp, said ballast circuit including a transformer having a primary winding coupled to said one transistor and a secondary winding coupled to said one discharge lamp, a capacitor coupled to the transformer primary winding to form a parallel resonant circuit for the oscillator-inverter circuit which exhibits a high oscillation operating frequency relative to said low frequency AC power source, means coupling the output of the rectifier circuit to said oscillator-inverter circuit to produce oscillation at said operating frequency, a regenerative power supply including means for switching said regenerative power supply into and out of circuit with the oscillator-inverter circuit as a function of a given voltage threshold level determined by the AC power source, thereby to produce a substantial change in the oscillation frequency of the oscillator-inverter circuit and in a sense that tends to maintain the lamp current constant in the operating condition of the lamp, and a frequency dependent impedance element whose electric impedance varies as a function of frequency and connected in series with said one discharge lamp across said transformer secondary winding and with its impedance being variable with said change in oscillation frequency in a sense to maintain the flow of lamp current within given limits.

2. An oscillator-inverter as claimed in claim 1 wherein said frequency dependent impedance element comprises either a capacitor or an inductor.

3. An oscillator-inverter as claimed in claim 1 wherein said regenerative power supply comprises, a third winding of said transformer for detecting the amplitude level of the oscillations in the oscillator-inverter circuit, and said regenerative power supply switching means includes a second capacitor and a diode coupled to said third winding and to the output of the rectifier circuit so that the diode is biased into conduction or cut-off dependent on the output voltage of the rectifier circuit and a voltage stored on the second capacitor by means of said third winding.

4. An oscillator-inverter as claimed in claim 3 wherein said regenerative power supply includes an LC circuit coupling said third winding to said diode and said second capacitor and arranged to function as an integration network to provide a smooth and continuous transfer of electric energy from the third winding to the second capacitor thereby to reduce the harmonic level of the AC current at said pair of input terminals.

5. An oscillator-inverter as claimed in claim 1 wherein the oscillator-inverter circuit comprises, first and second transistors connected in a push-pull circuit to said parallel resonant circuit, means coupled to control electrodes of the first and second transistors for alternately triggering said transistors into conduction and cut-off in mutually exclusive time periods, and a further winding for serially coupling the output of the rectifier circuit to a center tap on the transformer primary winding, and wherein the regenerative power supply comprises, a third winding of said transformer for detecting the amplitude level of the oscillations in the oscillator-inverter circuit, a second capacitor and a diode connected in series circuit across the output of the rectifier circuit, a second rectifier circuit, a parallel LC circuit, and means coupling said third winding to the second capacitor via the second rectifier circuit and the parallel LC circuit.

6. A high frequency oscillator-inverter for starting and operating at least one electric discharge lamp from a low frequency AC power source comprising, a pair of input terminals for connection to the AC power source, a rectifier circuit having an input coupled to the input terminals and an output for supplying a fluctuating DC voltage, an oscillator-inverter circuit including at least one transistor, a ballast coupling circuit for coupling the output voltage of the oscillator-inverter circuit to at least one said discharge lamp, said ballast circuit including a transformer having a primary winding coupled to said one transistor and a secondary winding coupled to said one discharge lamp, a capacitor coupled to the transformer primary winding to form a parallel resonant circuit for the oscillator-inverter circuit which exhibits a high oscillation operating frequency relative to said low frequency AC power source, means coupling the output of the rectifier circuit to said oscillator-inverter circuit to produce oscillation at said operating frequency, a regenerative power supply including means for switching said regenerative power supply into and out of circuit with the oscillator-inverter circuit as a function of a given voltage threshold level determined by the AC power source, thereby to produce a substantial change in the oscillation frequency of the oscillator-inverter circuit and in a sense that tends to maintain the lamp current constant in the operating condition of the lamp, and wherein said transformer comprises, a closed ferromagnetic core having two windows therein defining first and second ferromagnetic core legs and a third ferromagnetic core leg including a nonmagnetic gap for imparting a significant leakage inductance characteristic to the transformer, said primary winding being coupled to the first core leg and the secondary winding being coupled to the second core leg so as to provide a significant equivalent ballast inductance for limiting the flow of lamp current in the secondary winding, and filament heater winding means coupled to the second core leg and to at least one heater electrode of the discharge lamp, said transformer being operative to supply a lower filament heater current subsequent to ignition of the lamp than it supplies prior to lamp ignition.

7. An oscillator-inverter circuit as claimed in claim 6 wherein said transformer further comprises first and second windings coupled to said first core leg and electrically coupled to said regenerative power supply and to a control electrode of the one transistor, respectively.

8. A high frequency oscillator-inverter for starting and operating at least one electric discharge lamp from a low frequency AC power source comprising, a pair of input terminals for connection to the AC power source, a rectifier circuit having an input coupled to the input terminals and an output for supplying a fluctuating DC voltage, an oscillator-inverter circuit including at least one transistor, a ballast coupling circuit for coupling the output voltage of the oscillator-inverter circuit to at least one said discharge lamp, said ballast circuit including a transformer having a primary winding coupled to said one transistor and a secondary winding coupled to said one discharge lamp, a capacitor coupled to the transformer primary winding to form a parallel resonant circuit for the oscillator-inverter circuit which exhibits a high oscillation operating frequency relative to said low frequency AC power source, means coupling the output of the rectifier circuit to said oscillator-inverter circuit to produce oscillation at said operating frequency, a regenerative power supply including means for switching said regenerative power supply into and out of circuit with the oscillator-inverter circuit as a function of a given voltage threshold level determined by the AC power source, thereby to produce a substantial change in the oscillation frequency of the oscillator-inverter circuit and in a sense that tends to maintain the lamp current constant in the operating condition of the lamp, and wherein said regenerative power supply comprises a second rectifier circuit and a second capacitor energized by the high frequency energy of the oscillator-inverter circuit and with a parallel LC circuit coupling the second rectifier circuit to the second capacitor to provide a smooth and continuous energy transfer to the second capacitor, and said switching means comprises a semiconductor rectifying element which couples a voltage on the second capacitor in circuit with the first rectifier circuit to supplement said fluctuating DC voltage at said given voltage threshold level.

9. An oscillator-inverter as claimed in claim 8, wherein said parallel LC circuit comprises a parallel resonant tank circuit that substantially reduces odd order harmonics in the AC supply current for the oscillator-inverter.

10. A power supply for an electric discharge lamp comprising: a pair of input terminals for connection to a low frequency source of AC supply voltage, a rectifier circuit coupled to said input terminals and having an output at which a pulsating unidirectional voltage is developed, a high frequency oscillator-inverter circuit coupled to the output of said rectifier circuit and energized by said pulsating voltage, said oscillator-inverter circuit including a transformer having a primary winding coupled to the output of the rectifier circuit and a secondary winding, a capacitor connected in parallel with the primary winding to form a parallel resonant circuit for the oscillator-inverter and which develops a high frequency AC voltage for operation of a discharge lamp, a frequency dependent ballast coupling circuit including the transformer secondary winding for coupling said high frequency AC voltage to a discharge lamp, an auxiliary power supply coupled to said transformer and including a second rectifier circuit and a second capacitor for deriving a DC voltage sufficient to maintain oscillation in the oscillator-inverter circuit at a level to maintain ionization of a discharge lamp, switching means for connecting the second capacitor across the output of the first rectifier circuit whenever the pulsating voltage drops below a given voltage level thereby to change the resonant frequency of said parallel resonant circuit as a function of the condition of the switching means and in a sense such that the impedance of the ballast coupling circuit is varied so as to maintain a constant lamp current, an inductor coupling the output of the first rectifier circuit to a center tap on the transformer primary winding thereby to supply a substantially constant DC current to said primary winding, and wherein the ballast coupling circuit includes a third capacitor connected in series between the transformer secondary winding and a discharge lamp, said third capacitor and the components of the auxiliary power supply and the ballast coupling circuit being related such that the resonant frequency changes to cause the frequency of the high frequency AC voltage to decrease when the supply voltage to the oscillator-inverter is high and vice versa when the supply voltage is low.

11. A power supply for an electric discharge lamp comprising: a pair of input terminals for connection to a low frequency source of AC supply voltage, a first rectifier circuit coupled to said input terminals and having an output at which a fluctuating unidirectional voltage is developed, a high frequency oscillator-inverter circuit including a transformer having a primary winding coupled to the output of the first rectifier circuit and a secondary winding, a capacitor connected in parallel with the primary winding to form a parallel resonant circuit for the oscillator-inverter and which develops high frequency oscillations for operation of a discharge lamp, a frequency dependent ballast coupling circuit including the transformer secondary winding for coupling said high frequency oscillations to a discharge lamp, an auxiliary DC power supply coupled to said transformer and including a second rectifier circuit and a second capacitor for deriving a DC voltage on the second capacitor sufficient to maintain continuous oscillation in the oscillator-inverter circuit at a level to maintain continuous ionization of an operating discharge lamp, a rectifier element for connecting the second capacitor to the output of the first rectifier circuit whenever the fluctuating voltage drops below a given voltage level, and means including the auxiliary DC power supply for varying the oscillation frequency of the oscillator-inverter circuit in a sense to regulate the discharge current of an operating lamp.

12. A power supply as claimed in claim 11, wherein said frequency dependent ballast coupling circuit comprises a capacitor connected in circuit with the transformer secondary winding so as to be in series with a discharge lamp and having a capacitance value such that it varies the resonant frequency of the parallel resonant circuit to vary the high frequency oscillations inversely with the voltage level of the fluctuating unidirectional voltage so as to regulate the lamp discharge current.

13. A power supply as claimed in claim 11, wherein said oscillation frequency varying means also includes the ballast coupling circuit.

14. A power supply as claimed in claim 13 wherein the ballast coupling circuit further comprises a third capacitor coupled to the transformer secondary winding.

15. A power supply as claimed in claim 11, wherein said frequency-dependent ballast coupling circuit comprises a third capacitor connected in circuit with the transformer secondary winding so as to be in series with a discharge lamp, said third capacitor being operative to vary the oscillation frequency of the oscillator-inverter circuit as a function of the voltage level of the fluctuating voltage, the impedance of the third capacitor varying with said variation in oscillation frequency in a sense to maintain the lamp current within given limits.

16. A power supply as claimed in claim 11, wherein said auxiliary power supply includes a third winding coupled to the transformer, said power supply further comprising an inductor and capacitor forming an LC circuit that couples said third winding to the second capacitor.

* * * * *